US010189684B2

(12) United States Patent
Iguchi et al.

(10) Patent No.: US 10,189,684 B2
(45) Date of Patent: Jan. 29, 2019

(54) COUNTERWEIGHT ATTACHMENT AND REMOVAL DEVICE AND COMBINATION OF SAME WITH COUNTERWEIGHT

(71) Applicant: Caterpillar SARL, Geneva (CH)

(72) Inventors: Ryo Iguchi, Tokyo (JP); Kenichi Mori, Tokyo (JP); Hirokazu Hashimoto, Hyogo (JP)

(73) Assignee: Caterpillar SARL, Geneva (CH)

( * ) Notice: Subject to any disclaimer, the term of this patent is extended or adjusted under 35 U.S.C. 154(b) by 79 days.

(21) Appl. No.: 15/506,067

(22) PCT Filed: Aug. 26, 2015

(86) PCT No.: PCT/EP2015/069558

§ 371 (c)(1),
(2) Date: Feb. 23, 2017

(87) PCT Pub. No.: WO2016/030427

PCT Pub. Date: Mar. 3, 2016

(65) Prior Publication Data

US 2018/0222729 A1 Aug. 9, 2018

(30) Foreign Application Priority Data

Aug. 26, 2014 (JP) ..... 2014-171876

(51) Int. Cl.
*B66C 23/76* (2006.01)
*B66C 23/74* (2006.01)
*E02F 9/18* (2006.01)

(52) U.S. Cl.
CPC ..... *B66C 23/76* (2013.01); *B66C 23/74* (2013.01); *E02F 9/18* (2013.01)

(58) Field of Classification Search
CPC ..... B66C 23/76; B66C 23/74; E02F 9/18
See application file for complete search history.

(56) References Cited

U.S. PATENT DOCUMENTS 3,236,391 A * 2/1966 Kennedy ..... B66C 23/76 212/196
3,485,383 A * 12/1969 Beduhn ..... B66C 23/36 212/195

(Continued)

FOREIGN PATENT DOCUMENTS

JP 02-114223 U 9/1990
JP 07-268908 A 10/1995

(Continued)

*Primary Examiner* — Karen Beck

(57) ABSTRACT

A counterweight attachment and removal device which can connect lifting assemblies and a counterweight without precisely adjusting the construction machine position and the counterweight position, and which can attach the counterweight to adjust lateral direction. The device (18) includes a link (28) which is connected pivotally to the rear end of the construction machine, and a pair of coupling units (32, 32) which are connected to the leading end of the link (28). Each coupling unit (32) has a pair of coupling pieces (38, 40), a connecting pin (42) and a position adjustment member (44, 45). The coupling pieces (38, 40) extend from the link (28) and are able to tilt and move pivotally around the central axis (O). The connecting pin (42) is detachably connected to the extension ends between the connecting pieces (38, 40). Each adjustment member (44, 45) is disposed on the inner surface of the connecting piece (38, 40).

9 Claims, 4 Drawing Sheets

(56) References Cited

U.S. PATENT DOCUMENTS

| | | | | |
|---|---|---|---|---|
| 3,795,330 | A * | 3/1974 | Jorgensen | E02F 9/18 414/719 |
| 7,093,729 | B2 * | 8/2006 | Monteil | B66C 23/74 212/178 |
| 2012/0315121 | A1 | 12/2012 | Halepatali et al. | |

FOREIGN PATENT DOCUMENTS

| | | | |
|---|---|---|---|
| JP | 08-319637 | A | 12/1996 |
| JP | 2000-291070 | A | 10/2000 |
| JP | 2011-246926 | A | 12/2011 |

* cited by examiner

COUNTERWEIGHT ATTACHMENT AND REMOVAL DEVICE AND COMBINATION OF SAME WITH COUNTERWEIGHT

CROSS-REFERENCE TO RELATED APPLICATIONS

This application is a national phase application of International Patent Application No. PCT/EP2015/069558 filed Aug. 26, 2015, which claims priority to Japanese Patent Application No. 2014-171876 filed Aug. 28, 2014, both of which are incorporated by reference herein in their entireties for all purposes.

TECHNICAL FIELD

The present invention relates to a counterweight attachment and removal device and a combination of the counterweight attachment and removal device with a counterweight.

BACKGROUND ART

Japanese Patent Application Laid-open No. 2000-291070 discloses a counterweight attachment and removal device that allows a counterweight to be removably attached to a rear end of a construction machine such as an excavator or a hydraulic crane. The counterweight attachment and removal device includes a bracket fixed to the rear end of the construction machine, a link with a base end thereof connected to the bracket such that the link is able to be elevated and lowered, a link cylinder that allows the link to be elevated or lowered, and a coupling unit connected to a leading end of the link via a hydraulic cylinder. The counterweight attachment and removal device allows the counterweight to be removably attached to the rear end of the construction machine by coupling the coupling unit to the counterweight and hanging the counterweight using the link and the link cylinder.

In the above-described counterweight attachment and removal device, when the counterweight is attached, coupling of the coupling unit to the counterweight fails unless the position of the coupling unit is aligned with the position of the counterweight when the link is lowered. Thus, in the above-described counterweight attachment and removal device, when the counterweight is attached, an operation is needed in which the position of the construction machine and the position of the counterweight are precisely adjusted in order to allow the coupling unit and the counterweight to be coupled together. This operation, particularly a widthwise adjustment operation for the construction machine and the counterweight, is very burdensome for an operator.

DISCLOSURE OF THE INVENTION

The present invention has been developed with the above-described fact in view. A main technical object of the present invention is to provide a counterweight attachment and removal device and a combination of the counterweight attachment and removal device with a counterweight in which, when the counterweight is attached, a coupling unit and the counterweight can be coupled together even if an operation of adjusting the position of a construction machine and the position of the counterweight has not been precisely performed and in which the counterweight can be attached to a predetermined position in the construction machine by adjusting the widthwise position of the counterweight when the counterweight is lifted.

A first aspect of the present invention provides, as a counterweight attachment and removal device that accomplishes the above-described technical object, a counterweight attachment and removal device to and from which a counterweight is attached and removed, this counterweight attachment and removal device including: a bracket fixed to a rear end of a construction machine; a link with a base end thereof connected to the bracket such that the link is able to be elevated and lowered; a link cylinder that allows the link to be elevated and lowered; and a pair of coupling units disposed at a leading end of the link, wherein each of the pair of coupling units comprises: a pair of coupling pieces extending from one end thereof connected to the link so as to be able to slew around a center axis extending in a width direction and to tilt relative to the center axis, the coupling pieces being disposed at a distance from each other in the width direction; and a coupling pin removably connected between extension ends of the pair of coupling pieces, and wherein a width between the pair of coupling pieces on a side further toward the extension ends thereof than the coupling pin is formed narrow.

Preferably, at the extension ends of the pair of coupling pieces of each of the pair of coupling units, position adjustment members are disposed which protrude from inner surfaces positioned further toward the extension ends than the coupling pin so that the width between the pair of coupling pieces on a side further toward the extension ends thereof than the coupling pin is formed narrow. Advantageously, the position adjustment members of the pair of coupling units are each disposed at both extension ends of the pair of coupling pieces. Suitably, the position adjustment members of the pair of coupling units are each disposed at one of the extension ends of the pair of coupling pieces. Preferably, the position adjustment members of the pair of coupling units are each disposed on one of the coupling pieces of each coupling unit of the pair of coupling units that is positioned inside or on one of the coupling pieces of each coupling unit of the pair of coupling units that is positioned outside. Advantageously, a slot extending in an extension direction of the pair of coupling pieces is formed in each of the extension ends of the pair of coupling pieces, and the coupling pin is inserted through each of the slots and removably connected to the pair of coupling pieces. Suitably, a support shaft extending in the width direction is fixed to the leading end of the link, and each coupling unit of the pair of coupling units is connected to the support shaft via a spherical plain bearing so as to be able to slew around a center axis of the support shaft and to tilt to the center axis of the support shaft.

A second aspect of the present invention provides, as a combination that accomplishes the technical object, a combination of the counterweight attachment and removal device as described with a counterweight, wherein the counterweight includes at least one tapered protrusion disposed on a front surface of the counterweight and protruding forward, the counterweight attachment and removal device includes an abutting contact member with at least one receiving hole having a width gradually decreasing in an upward direction, and a width of a lower end of the receiving hole is larger than an outer diameter of a leading end of the tapered protrusion.

In a suitable form, a pair of the tapered protrusions and a pair of the receiving holes are disposed such that the tapered protrusions are arranged at a distance from each other and the receiving holes are arranged at a distance from each other in the width direction.

In the counterweight attachment and removal device provided according to the first aspect of the present invention, when the counterweight is attached, the coupling units and the counterweight can be coupled together by slewing each coupling unit around the center axis extending in the width direction and/or tilting each coupling unit to the center axis even if an operation of adjusting the position of a construction machine and the position of the counterweight has not been precisely performed.

Furthermore, in the counterweight attachment and removal device provided according to the first aspect of the present invention, the width between the pair of coupling pieces on a side further toward the extension ends thereof than the coupling pin is formed narrow. Thus, even with each coupling unit tilted relative to the center axis, the coupling unit and the counterweight are coupled together at a predetermined position of the coupling unit in the width direction. Consequently, the counterweight, when lifted, can be attached to a predetermined position on the construction machine by adjusting a widthwise position of the counterweight.

In the combination of the counterweight attachment and removal device as described above with the counterweight provided according to the second aspect of the present invention, when the counterweight is lifted by the counterweight attachment and removal device and approaches the construction machine along a circular arc trajectory from a position behind and below the construction machine, the leading end side of the tapered protrusion is inserted into a lower part of the receiving hole in the abutting contact member. When the counterweight further approaches the construction machine, the tapered protrusion moves upward and forward while being regulated by the receiving hole. Consequently, in the combination according to the present invention, the tapered protrusion and the receiving hole cooperate with each other in adjusting the widthwise position of the counterweight, allowing the counterweight to be attached to the predetermined position on the construction machine.

BEST MODE FOR CARRYING OUT THE INVENTION

With reference to the attached drawings, an embodiment of the present invention will be described below in detail taking, as an example, an excavator that is a typical construction machine; the embodiment relates to a counterweight attachment and removal device configured according to the present invention and a combination of the counterweight attachment and removal device with a counterweight.

Figure 1:
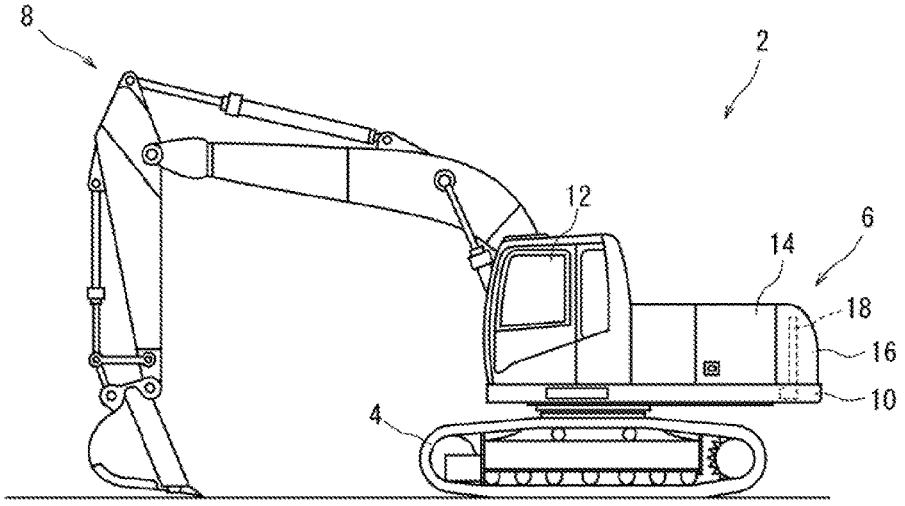
FIG. 1 is a side view of an excavator including a counterweight attachment and removal device and a counterweight configured according to the present invention.

The embodiment will be described with reference to FIG. 1. An excavator generally depicted by reference numeral 2 roughly includes a mobile lower traveling body 4, an upper slewing body 6 mounted on the lower traveling body 4 so as to be able to slew, and a working arm device 8 connected to a front portion of the upper slewing body 6 so as to be able to be elevated and lowered. The excavator 2 can perform an excavation operation for sediment or the like by elevating or lowering the working arm device 8 and slewing the upper slewing body 6 with respect to the lower traveling body 4.

The upper slewing body 6 includes a slewing frame 10 forming a framework structure. The slewing frame 10 is equipped with, for example, a cab 12 in which an operator resides, an equipment housing room 14 in which equipment such as an engine and a hydraulic pump is housed, a counterweight 16 that allows a weight balance to be kept with the working arm device 8, and a counterweight attachment and removal device 18 that allows the counterweight 16 to be removably attached.

For the arrangement positions of these components, the cab 12 is disposed on a left front side of the slewing frame 10. Furthermore, the equipment housing room 14 is disposed behind the cab 12, and the counterweight 16 is disposed at a rear end of the slewing frame 10. The counterweight attachment and removal device 18 is housed at the rear end of the slewing frame 10 and inside the counterweight 16. A front-rear direction and a lateral direction (width direction) as used in the description of this Description refer to the front-rear direction and the lateral direction (width direction) as viewed from the operator residing in the cab 12 in FIG. 1.

Figure 2:
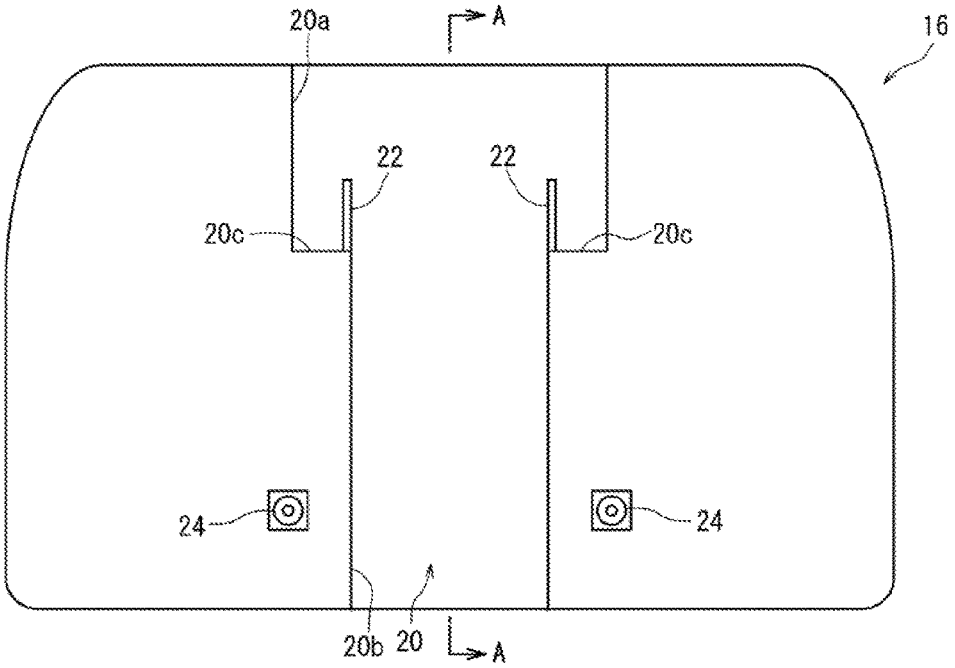
FIG. 2 is a front view of the counterweight depicted in FIG. 1.
Figure 3:
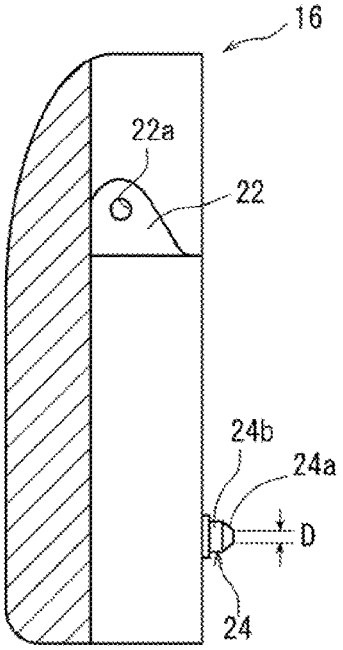
FIG. 3 is a sectional view taken along line A-A in FIG. 2.

The embodiment will be described with reference to FIG. 2 and FIG. 3. The counterweight 16 is shaped generally like a rectangular parallelepiped. A front surface of the counterweight 16 is sunken inward at a central portion 20 in the width direction. The counterweight attachment and removal device 18 is housed in the sunken central portion 20.

The sunken central portion 20 has an upper portion 20*a* formed to be relatively large in the width direction and a lower portion 20*b* formed to be smaller than the upper portion 20*a* in the width dimension. A pair of horizontal surfaces 20*c* extending in a substantially horizontal direction is formed between the upper portion 20*a* and the lower portion 20*b*. A pair of coupling plates 22 extending in the front-rear direction is erected on each of the horizontal surfaces 20*c*. Coupling pin insertion holes 22*a* through which coupling pins 42 described below are inserted are formed in the respective coupling plates 22, to form a coupling portion coupled to the counterweight attachment and removal device 18.

A pair of tapered protrusions 24 protruding forward is disposed on the front surface of the counterweight 16. The tapered protrusions 24 are positioned on the left and right, respectively, of the sunken central portion 20 and disposed at a distance from each other in the width direction. The tapered protrusion 24 is shaped like a cone on a leading end side 24*a* and like a cylinder on a base end side 24*b*, and tapered from an intermediate area toward the leading end side 24*a*. The tapered protrusion may be shaped like a prismatic column on the base end side and like a pyramid on the leading end side.

The embodiment will be described with reference to FIG. 4 and FIG. 5. The counterweight attachment and removal device 18 includes a bracket 26 fixed to a rear end of the slewing frame 10, a link 28 and a link cylinder 30 both connected to the bracket 26, a pair of coupling units 32 disposed at a leading end of the link 28, and a pair of abutting contact members 34 disposed on the left and right, respectively, of the bracket 26.

The bracket 26 is shaped like the letter U as viewed in an up-down direction, the letter U being defined by a horizontal plate 26*a* extending in the width direction and a pair of vertical plates 26*b* arranged at a distance from each other and extending rearward from a rear surface of the horizontal plate 26*a*. A front surface of the horizontal plate 26*a* is connected to the rear end of the slewing frame 10. An extension end of the vertical plate 26*b* extends so as to incline rearward from an upper end toward a lower end the vertical plate 26*b*.

The link 28 has a pair of link pieces 28*a* arranged at a distance from each other in the width direction and extending straight from the bracket 26, a connection piece 28*b* disposed between the link pieces 28*a*, and a cylindrical support shaft 28*c* fixed at leading ends of the link pieces 28*a* and extending in the width direction. Base ends of the link pieces 28*a* are connected, by pin coupling, to upper portions of extension ends of the vertical plates 26*b* of the bracket 26 so as to be able to be elevated and lowered. Widthwise opposite ends of the connection piece 28*b* are joined to inner surfaces of the link pieces 28*a*, respectively.

The link cylinder 30 is a hydraulic cylinder that allows the link 28 to be elevated and lowered. A base end of the link cylinder 30 is connected, by pin coupling, to lower portions of extension ends of the vertical plates 26*b* of the bracket 26 such that the link cylinder 30 can be elevated and lowered. A leading end of the link cylinder 30 is pivotally connected to the support shaft 28*c* of the link 28. Furthermore, the leading end of the link cylinder 30 is positioned between leading ends of the link pieces 28*a*.

The coupling units 32 are positioned on the left and right, respectively, of the link pieces 28*a* so as to sandwich the link pieces 28*a* between the coupling units 32. A cylindrical bearing portion 36 is formed at one end of the coupling unit 32. A spherical plain bearing (not depicted in the drawings) is built in the bearing portion 36. The coupling unit 32 is connected via the spherical plain bearing to the support shaft 28*c* so as to be able to pivot around a center axis O of the support shaft 28*c* in a direction depicted by arrow S in FIG. 5. Furthermore, the coupling unit 32 is connected via the spherical plain bearing to the support shaft 28*c* so as to be able to tilt in a direction depicted by arrow T in FIG. 4, with respect to the center axis O.

Furthermore, the coupling unit 32 includes a pair of coupling pieces 38, 40 extending radially outward of the bearing portion 36 from axially opposite ends of the bearing portion 36, a coupling pin 42 connected between the coupling pieces 38, 40, and a pair of position adjustment members 44, 45 disposed on the respective coupling pieces 38, 40.

A pair of slots 38*a*, 40*a* extending in an extension direction of the coupling pieces 38, 40 is formed at extension ends of the coupling pieces 38, 40, respectively. The slot 38*a* and the slot 40*a* have the same shape, and thus, only the slot 40*a* is depicted, with illustration of the slot 38*a* omitted. The coupling pin 42 is inserted through the slots 38*a*, 40*a* and connected between the extension ends of the coupling pieces 38, 40. Furthermore, the coupling pin 42 is formed to be cylindrical and removably connected to the coupling pieces 38, 40 using a pair of retaining members 46 disposed at axially opposite ends of the coupling pin 42, and bolts and nuts.

Figure 6:
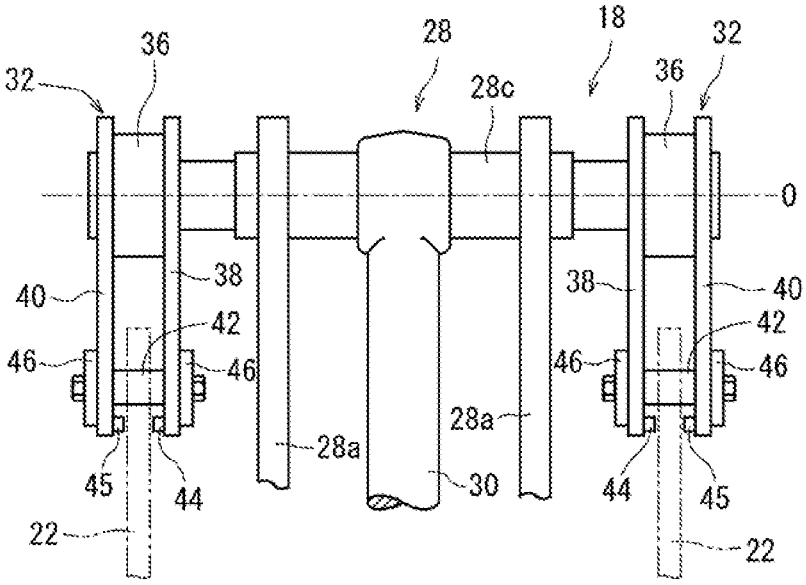
FIG. 6 is an enlarged partial rear view depicting an enlarged part of FIG. 4.
Figure 7:
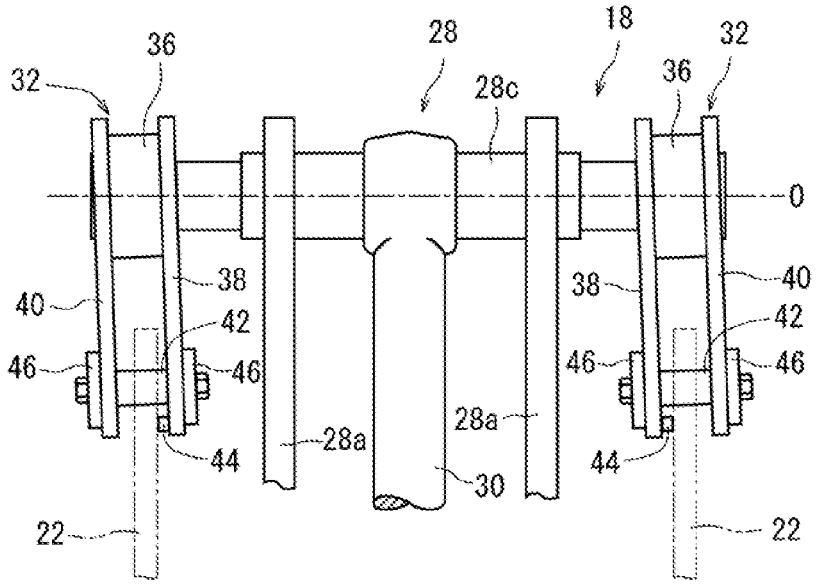
FIG. 7 is an enlarged partial rear view similar to FIG. 6, illustrating a case where a position adjustment member is disposed on an inner coupling piece.
Figure 8:
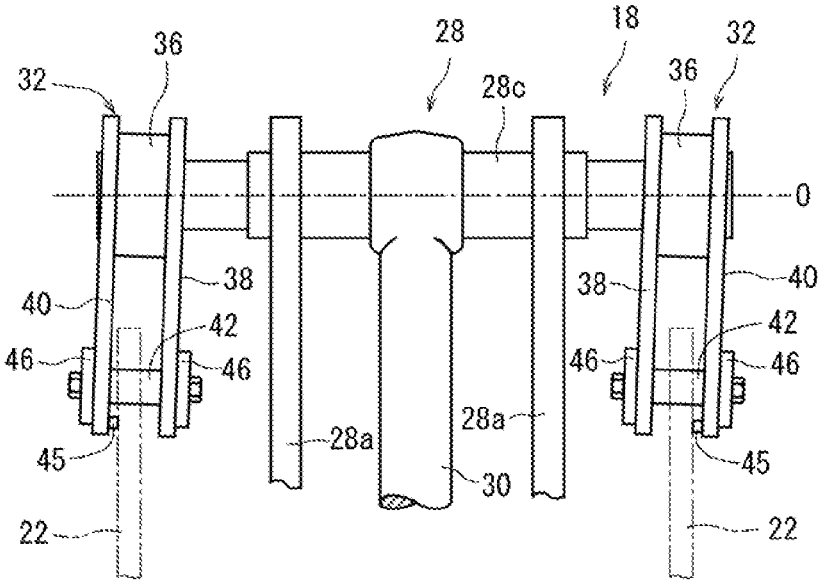
FIG. 8 is an enlarged partial rear view similar to FIG. 6, illustrating a case where the position adjustment member is disposed on an outer coupling piece.

The embodiment will be described with reference to FIG. 6. The position adjustment members 44, 45 of each of the coupling units 32 are disposed so as to protrude from inner surfaces positioned further toward the extension ends of the coupling pieces 38, 40 than the coupling pin 42. Thus, a width between the pair of coupling pieces 38, 90 on a side further toward the extension ends thereof than the coupling pin 42 is formed narrow. The widthwise dimension between the position adjustment members 44, 45 formed to be smaller is preferably slightly larger than the thickness dimension of the coupling plate 22 of the counterweight 16. The position adjustment member may be disposed at the extension end of one of the coupling pieces of each coupling unit. For example, the position adjustment members 44 may be disposed at the extension ends of the coupling pieces 38 of the coupling units 32, which are positioned inside (closer to the link piece 28*a*), as depicted in FIG. 7 or the position adjustment members 45 may be disposed at the extension ends of the coupling pieces 40 of the coupling units 32, which are positioned outside (farther from the link piece 28*a*), as depicted in FIG. 8. Furthermore, in the description of the embodiment, the coupling piece and the position adjustment member are separate members. However, the coupling piece and the position adjustment member may be configured using one integrally formed member.

Figure 4:
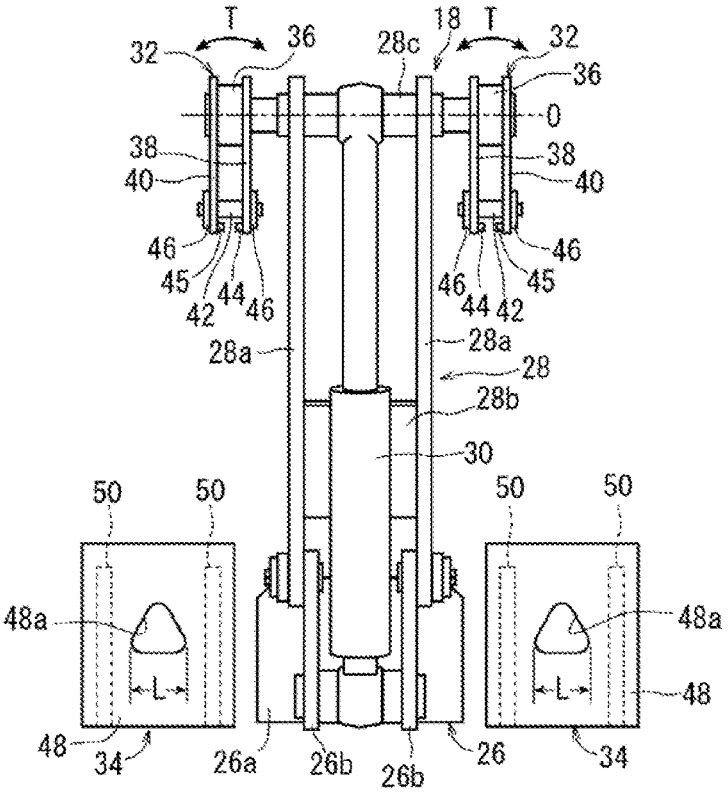
FIG. 4 is a rear view of the counterweight attachment and removal device depicted in FIG. 1.
Figure 5:
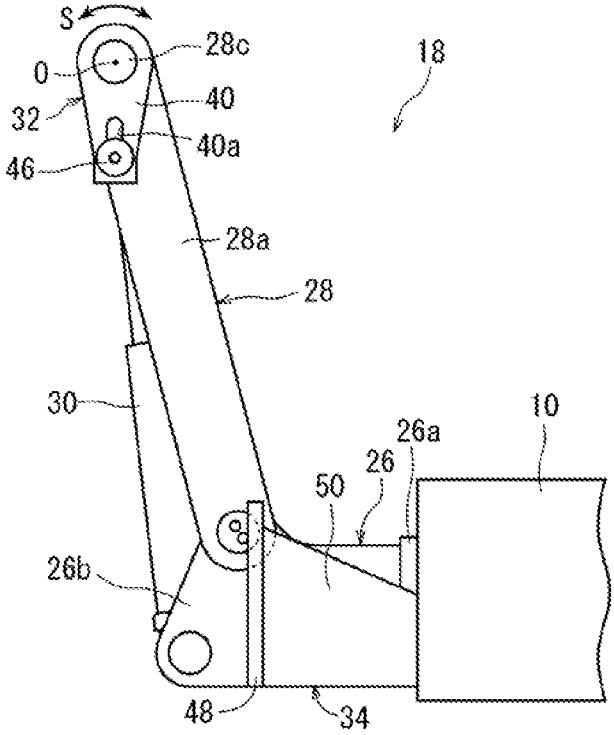
FIG. 5 is a side view of the counterweight attachment and removal device depicted in FIG. 1.

As depicted in FIG. 4 and FIG. 5, the abutting contact member 34 includes an abutting contact plate 48 extending in the width direction and a pair of connection plates 50 arranged at a distance from each other in the width direction and extending forward from a front surface of the abutting contact plate 48. An extension end of the connection plate 50 is connected to a rear end of the slewing frame 10. In a central portion of the abutting contact plate 48, a triangular receiving hole 48*a* is formed which has a width gradually decreasing in an upward direction. The receiving hole 48*a* is positioned in association with the tapered protrusion 24 of the counterweight 16. The width L of a lower end of the receiving hole 48*a* is formed to be larger than the outer diameter D of a leading end of the tapered protrusion 24. In the present embodiment, a lateral pair of the tapered protrusions 24 and a lateral pair of the receiving holes 48*a* are disposed. However, one tapered protrusion 24 and one receiving hole 48*a* may be disposed.

For the counterweight attachment and removal device 18 and the combination of the counterweight attachment and removal device 18 with the counterweight 16 in the excavator 2 depicted in FIGS. 1 to 8, as described above, effects thereof will be described below.

In the counterweight attachment and removal device 18 according to the present invention, when the counterweight 16 installed on the ground or the like is attached to the excavator 2, the coupling units 32 can be coupled to the counterweight 16 even if an operation of adjusting the position of the excavator 2 (particularly the upper slewing body 6) and the position of the counterweight 16 has not been precisely performed. That is, the coupling units 32 are slewed around the center axis O of the support shaft 28*c* and/or tilted relative to the center axis O to insert the coupling pins 42 of the coupling units 32 through the coupling pin insertion holes 22*a* in the coupling plates 22 when the link 28 is lowered.

Furthermore, in the counterweight attachment and removal device 18 according to the present invention, the width between the pair of coupling pieces 38, 40 on a side further toward the extension ends thereof than the coupling pin 42 is formed narrow. Thus, as depicted in FIG. 7 and FIG. 8, even with the coupling units 32 tilted relative to the center axis O, the coupling pins 42 are coupled to the coupling pin insertion holes 22*a* at predetermined positions of the coupling pins 42 in the axial direction. Consequently, the counterweight 16, when lifted, can be attached to a predetermined position on the excavator 2 by adjusting the widthwise position of the counterweight 16.

In the combination of the counterweight attachment and removal device 18 with the counterweight 16 according to the present invention, when the counterweight 16 is lifted by the counterweight attachment and removal device 18 and approaches the excavator 2 along a circular arc trajectory from a position behind and below the excavator 2, the leading end sides 24*a* of the tapered protrusions 24 are inserted into lower parts of the receiving holes 48*a* in the abutting contact plates 48. When the counterweight 16 further approaches the excavator 2, the tapered protrusions 24 move upward and forward while being regulated by the receiving holes 48*a*. Consequently, in the combination according to the present invention, the tapered protrusions 24 and the receiving holes 48*a* cooperate with one another in adjusting the widthwise position of the counterweight 16, allowing the counterweight 16 to be attached to the predetermined position on the excavator 2.

The invention claimed is:

1. A counterweight attachment and removal device to and from which a counterweight is attached and removed, the counterweight attachment and removal device comprising:

a bracket fixed to a rear end of a construction machine;

a link with a base end thereof connected to the bracket;

a link cylinder configured to elevate and lower the link; and a pair of coupling units disposed at a leading end of the link, wherein each of the pair of coupling units comprises:

a pair of coupling pieces extending from the link and configured to slew around a center axis of the link extending in a width direction and to tilt relative to the center axis, the coupling pieces being disposed at a distance from each other in the width direction; and a coupling pin removably connected between extension ends of the pair of coupling pieces.

2. The counterweight attachment and removal device according to claim 1, wherein at the extension ends of the pair of coupling pieces of each of the pair of coupling units, position adjustment members are disposed which protrude from an inner surface positioned further toward the extension ends than the coupling pin, so that the width between the pair of coupling pieces on a side further toward the extension ends thereof than the coupling pin is formed more narrowly.

3. The counterweight attachment and removal device according to claim 2, wherein the position adjustment members are disposed at extension ends of both of the pair of coupling pieces.

4. The counterweight attachment and removal device according to claim 2, wherein the position adjustment members are each disposed at the extension ends of only one of the pair of coupling pieces.

5. The counterweight attachment and removal device according to claim 4, wherein the position adjustment member is disposed on an inside one the coupling piece of each of the pair of coupling units that is positioned nearer to link pieces connected to the bracket.

6. The counterweight attachment and removal device according to claim 1, wherein a slot extending in an extension direction of the pair of coupling pieces is formed in each of the extension ends of the pair of coupling pieces, and the coupling pin is inserted through each of the slots and removably connected to the pair of coupling pieces.

7. The counterweight attachment and removal device according to claim 1, wherein a support shaft extending in the width direction is fixed to a pair of link pieces at the leading end of the link, and each of the pair of coupling units is connected to the support shaft via a spherical plain bearing so as to be able to slew around a center axis of the support shaft and to tilt relative to the center axis of the support shaft.

8. A combination of the counterweight attachment and removal device according to claim 1 with a counterweight, wherein the counterweight comprises at least one tapered protrusion disposed on a front surface of the counterweight and protruding forward, the counterweight attachment and removal device includes an abutting contact member with at least one receiving hole having a width gradually decreasing in an upward direction, and a width of a lower end of the receiving hole is larger than an outer diameter of a leading end of the tapered protrusion.

9. The combination according to claim 8, wherein a pair of tapered protrusions and a pair of receiving holes are disposed such that both the tapered protrusions and the receiving holes are arranged at an interval from each other in the width direction.

* * * * *